United States Patent [19]

Manoly

[11] 4,229,676

[45] Oct. 21, 1980

[54] HELICAL SLOW-WAVE STRUCTURE ASSEMBLIES AND FABRICATION METHODS

[75] Inventor: Arthur E. Manoly, Palos Verdes, Calif.

[73] Assignee: Hughes Aircraft Company, Culver City, Calif.

[21] Appl. No.: 21,146

[22] Filed: Mar. 16, 1979

[51] Int. Cl.[1] ..... H01J 25/34

[52] U.S. Cl. ..... 315/3.5; 29/600; 29/25.14; 333/163; 315/3.6; 315/39.3

[58] Field of Search ..... 315/3.5, 3.6, 39.3; 333/31 R; 29/25.14, 600

[56] References Cited

U.S. PATENT DOCUMENTS

| | | | |
|---|---|---|---|
| 2,850,666 | 9/1958 | Brewer | 315/3.5 |
| 2,889,487 | 6/1959 | Birdsall et al. | 315/3.6 |
| 3,519,964 | 7/1970 | Chorney et al. | 315/3.5 X |
| 3,610,999 | 10/1971 | Falce | 315/39.3 |
| 3,670,197 | 6/1972 | Unger | 315/3.5 |
| 3,925,738 | 12/1975 | Bates et al. | 315/3.5 |
| 4,115,721 | 9/1978 | Friz | 315/3.5 |

*Primary Examiner*—Saxfield Chatmon, Jr.
*Attorney, Agent, or Firm*—Paul M. Coble; W. H. MacAllister

[57] ABSTRACT

Helical slow-wave structure assemblies including a helical dielectric supporting member are disclosed along with methods for fabricating such assemblies. After the slow-wave structure helix is wound on a mandrel, a masking helix is coaxially wound about the slow-wave structure helix in the same sense as the slow-wave structure helix over the helical space between turns of the slow-wave structure helix and in overlapping relationship with portions of adjacent turns of the slow-wave structure helix. The supporting helix is formed by plasma spraying dielectric material into the helical space between turns of the masking helix. The dielectric material is ground to a predetermined radial dimension, and the mandrel and the masking helix are removed. By utilizing a masking helix of tapered width, a dielectric supporting helix of tapered width may be fabricated to provide a slow-wave structure assembly with a tapered phase velocity. A slow-wave structure helix having a radially outwardly extending longitudinal ridge may be utilized to provide a structure of wide bandwidth.

11 Claims, 15 Drawing Figures

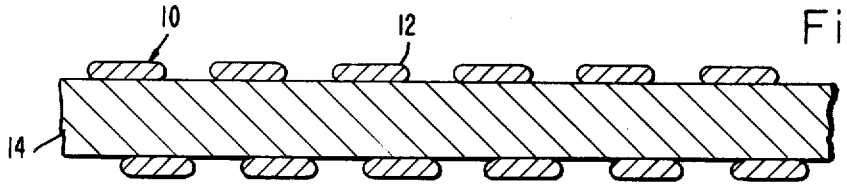
Fig. 1.
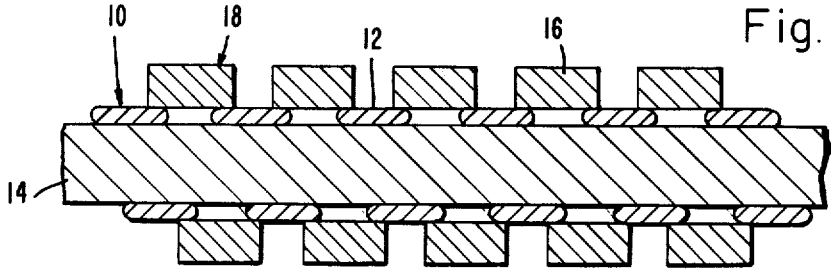
Fig. 2.
Fig. 3.
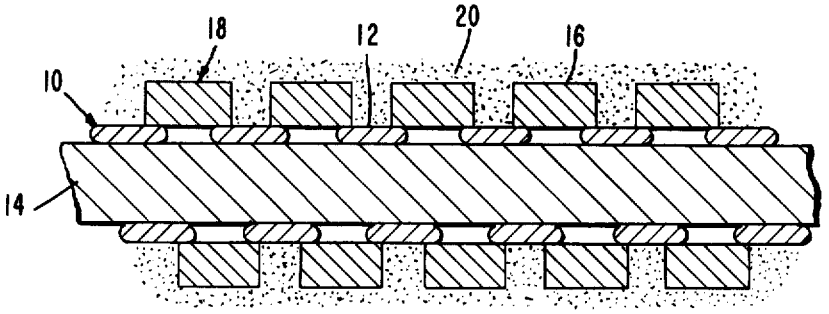
Fig. 4.
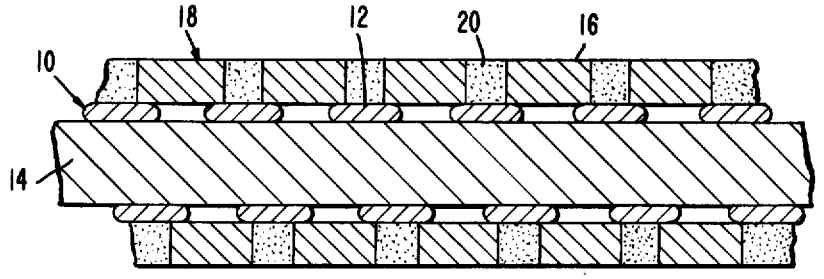

HELICAL SLOW-WAVE STRUCTURE ASSEMBLIES AND FABRICATION METHODS

The invention described herein was made in the course of or under a contract or subcontract thereunder with the United States Air Force.

BACKGROUND OF THE INVENTION

1. Field of the Invention

This invention relates generally to microwave devices, and more particularly, it relates to slow-wave structure assemblies for use in traveling-wave tubes and methods for fabricating such assemblies.

2. Description of the Prior Art including Prior Art Statement

In traveling-wave tubes a stream of electrons is caused to interact with a propagating electromagnetic wave in a manner which amplifies the electromagnetic wave energy. In order to achieve the desired interaction, the electromagnetic wave is propagated along a slow-wave structure, such as an electrically conductive helix wound about the path of the electron stream. The slow-wave structure provides a path of propagation for the electromagnetic wave which is considerably longer than the axial length of the structure so that the traveling wave may be made to propagate axially at nearly the velocity of the electron stream.

Initially, slow-wave structures of the helix type were usually supported within a tubular housing by means of a plurality of longitudinally disposed dielectric rods equally circumferentially spaced about the slow-wave structure helix. More recently, supporting assemblies for helical slow-wave structures have been devised which employ a coaxial helix of dielectric material wound in the same sense as the slow-wave structure helix between the slow-wave structure helix and the housing.

Helical supporting arrangements for slow-wave structures and methods for fabricating such arrangements are disclosed in U.S. Pat. No. 3,670,196 to Burton H. Smith. As disclosed in the Smith patent, a mandrel is provided with a helical groove conforming to the desired pitch of the slow-wave structure helix, and the slow-wave structure helix is wound in this groove. A dielectric helix provided with suitable braze material is then wound in the aforementioned groove over the slow-wave structure helix, the dielectric helix having a sufficient radial extent to project radially outwardly from the mandrel groove. The assembly is then inserted into a tubular housing, and the circumferentially outer surface of the dielectric helix is brazed to the housing, after which the mandrel is removed by chemical etching.

A modification to the aforedescribed technique for fabricating helical supporting arrangements for slow-wave structures is disclosed in U.S. Pat. No. 4,115,721 to Walter Friz. The process disclosed in the Friz patent is similar to that of the Smith patent, except that instead of mechanically winding a helical dielectric member in the mandrel groove, the dielectric material is plasma sprayed into the groove on the exposed surface of the previously wound slow-wave structure helix, after which the mandrel and the plasma-sprayed dielectric material are precision ground to the desired radial dimension.

A further consideration in the design of traveling-wave tubes is that the interaction between the electron stream and the traveling wave causes a gradual reduction in the axial velocity of the electron stream as it traverses the tube. As a result, the relative axial velocities of the electron stream and the traveling wave may become appreciably different from one another near the output end of the tube, thereby reducing operating efficiency. In the past, for traveling-wave tubes with helical slow-wave structures, this problem has been solved by gradually decreasing the pitch of the helical slow-wave structure along the path of the electron stream to cause the axial velocity of the traveling wave to decrease in a manner corresponding to the decrease in the axial velocity of the electron stream. Helical slow-wave structures of decreasing pitch are disclosed in U.S. Pat. No. 2,851,630 to Charles K. Birdsall.

A further consideration applicable to the design of wide bandwidth traveling-wave tube involves conductively loading the slow-wave structure of the tube to achieve the necessary phase velocity verses frequency characteristic for the traveling waves that facilitates wide bandwidth operation. A representative prior art conductive loading arrangement for increasing the bandwidth of a traveling-wave tube employing a helical slow-wave structure is disclosed in U.S. Pat. No. 3,972,005 to John E. Nevins, Jr. et al. The conductive loading structure of this patent includes a plurality of elongated open-sided conductive channel members extending radially inwardly from the slow-wave structure housing with the open side of each channel member facing the slow-wave structure.

SUMMARY OF THE INVENTION

It is an object of the present invention to provide a helical slow-wave structure assembly including a helical dielectric supporting member, especially suitable for traveling-wave tubes, which achieves increased operating efficiency and higher gain per unit length of the slow-wave structure than with prior art assemblies of this type.

It is a further object of the invention to provide a slow-wave structure assembly of the foregoing type which is capable of operating at higher frequencies than heretofore has been achieved with this type of slow-wave structure assembly.

It is another object of the invention to provide a helical slow-wave structure assembly of the type designed to compensate for a reduction in the axial velocity of the traveling wave near the output end of the structure, and which enable a higher traveling wave phase velocity and a higher traveling wave-electron stream interaction impedance near the input end of the structure and greater thermal capability near the output end than prior art assemblies of this type.

It is still a further object of the invention to provide a helical slow-wave structure assembly of the type designed for wide bandwidth operation which not only is of simpler construction, but which also achieves increased interaction impedance in the high frequency region of the structure passband than prior art assemblies of this type, thereby increasing operating efficiency and gain in the high frequency region.

It is yet another object of the invention to provide a simple and reliable method for fabricating a helical slow-wave structure assembly including a helical dielectric supporting member with lower manufacturing cost than prior art methods for making assemblies of this type.

It is still a further object of the invention to provide a method for fabricating slow-wave structure assemblies of the foregoing type which affords greater control over various design parameters than has been possible with methods of the prior art.

In the basic method of the invention, a first ribbon of an electrically conductive material unsusceptible to etching by a predetermined etchant is wound on a cylindrical mandrel to form a slow-wave structure helix having a predetermined spacing between successive turns thereof. A second ribbon of a material susceptible to etching by the predetermined etchant and having a width greater than the aforementioned predetermined spacing is wound about the slow-wave structure helix over the helical space between turns of the slow-wave structure helix and in overlapping relationship with portions of adjacent turns of the slow-wave structure helix to form a masking helix. Dielectric material unsusceptible to etching by the predetermined etchant is deposited over the exposed surfaces of the slow-wave structure and the masking helices, after which the deposited dielectric material is ground to a predetermined radial dimension. The mandrel and the masking helix are then removed from the resulting assembly, and the assembly is mounted within a tubular housing with the circumferentially outer surface of the dielectric material firmly contacting the inner surface of the housing.

In the resultant slow-wave structure assembly, a reduced amount of dielectric material is present in regions of high electromagnetic fields. This enables a higher traveling wave-electron stream interaction impedance to be achieved, resulting in increased operating efficiency and higher gain per unit length of the assembly.

In a further embodiment of the invention, at least a portion of the second ribbon has a tapered width, whereby the spacing between adjacent turns of the masking helix varies gradually as a function of axial distance along the helix. In the resultant slow-wave structure assembly, at least a portion of the dielectric helix which supports the slow-wave structure helix has a width which varies gradually as a function of axial distance along the helices, thereby enabling the phase velocity of the traveling wave to be gradually reduced toward the output end of the assembly.

In a still further embodiment of the invention, the first ribbon has a base portion and a longitudinal ridge portion of a width less than the width of the base portion which extends outwardly from the base portion such that the base portion defines laterally extending portions on both sides of the ridge portion, and this ribbon is wound on the mandrel such that the ridge portion extends radially outwardly from the base portion. The second ribbon has a width approximately equal to the spacing between adjacent turns of the ridge portion of the first ribbon and is disposed between successive turns of the ridge portion in overlapping relationship with the laterally extending regions of the base portion. The resulting assembly has a ridged slow-wave structure helix which not only enables a wide bandwidth to be achieved, but which also increases the interaction impedance (hence operating efficiency and gain) at frequencies in the upper region of the passband.

Additional objects, advantages and characteristic features of the invention will become apparent from the following detailed description of preferred embodiments of the invention when considered in conjunction with the accompanying drawings.

BRIEF DESCRIPTION OF THE DRAWINGS

In the accompanying drawings:

FIGS. 1, 2, 3, 4, 5, 6 and 7 illustrate a helical slow-wave structure assembly at successive stages of its fabrication according to the basic method of the invention, the resulting assembly being illustrated in FIG. 7;

DESCRIPTION OF PREFERRED EMBODIMENTS

Figure 5:
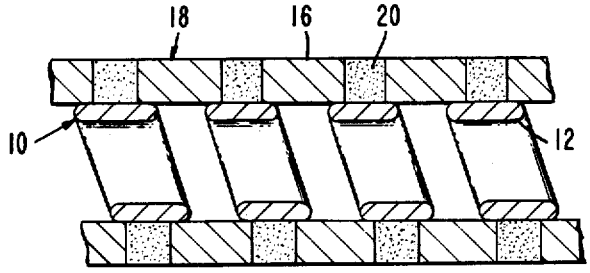

Referring to the drawings with greater particularity, in FIG. 1 there is shown a slow-wave structure helix 10 formed by winding a ribbon 12 of electrically conductive material on a cylindrical mandrel 14. The material of the ribbon 12 must be unsusceptible to etching by a predetermined etchant used in a subsequent processing step. In contrast to the grooved mandrels employed in the methods of the aforementioned U.S. Pat. Nos. 3,670,196 and 4,115,721, the mandrel 14 is not grooved, and the material of the mandrel 14 need not be susceptible to etching by the predetermined etchant, but rather may be selected solely on the basis of other criteria such as strength or rigidity. Preferred materials for the slow-wave structure ribbon 12 are copper, copper-plated tungsten and copper-plated molybdenum, while preferred materials for the mandrel 14 are molybdenum or tungsten. The helix 10 is wound with a predetermined spacing between successive turns thereof in accordance with desired wave-propagating characteristics for the slow-wave structure being fabricated.

As shown in FIG. 2, a ribbon 16 having a width greater than the spacing between turns of the slow-wave structure helix 10 is then coaxially wound about the helix 10 in the same sense as the helix 10 over the helical space between turns of the helix 10 and in overlapping relationship with portions of adjacent turns of the helix 10. The wound ribbon 16 forms a masking helix 18 for use in a subsequent step involving the deposition of dielectric material over the helix 10. The width of the masking helix 18 determines the amount of surface area of the slow-wave structure helix 10 exposed to the dielectric material being deposited and is selected according to the desired width of the dielectric supporting helix being fabricated, the greater the width of the masking helix 18, the smaller the width of the dielectric supporting helix. In order to facilitate removal of the masking helix 18 after the dielectric deposition step, the ribbon 16 should be of a material susceptible to etching by the aforementioned predetermined etchant. An example of a preferred material for the ribbon 16 is aluminum, although other materials are also suitable and may be employed instead.

As shown in FIG. 3, dielectric material 20 for the slow-wave structure supporting member is then deposited over the masking helix 18 and the exposed surface of the slow-wave structure helix 10. The dielectric material should have a low dielectric constant and a high thermal conductivity and must be unsusceptible to etching by the aforementioned predetermined etchant. Exemplary dielectric materials which may be employed are beryllia and alumina. Preferably, the dielectric material is deposited by plasma spraying, although other methods of particulate deposition may be used. An example of a particular plasma spray gun which may be employed is a Plasma Flame Spray Gun sold by Metco Inc., 1101 Prospect Avenue, Westbury, Long Island, New York 11590, although similar plasma spray guns are also suitable. As may be seen from FIG. 3, a sufficient amount of dielectric material 20 is deposited to completely fill the helical space between turns of the masking helix 18 as well as to cover all exposed surfaces of the masking helix 18.

Excess deposited dielectric material is then removed by precision grinding the assembly of FIG. 3 to a predetermined radial dimension to provide the structure shown in FIG. 4. In the structure of FIG. 4 sufficient dielectric material has been removed to expose the outer surface of the masking helix 18, although dielectric material may be allowed to remain on the outer surface of the masking helix 18 if desired to increase mechanical strength or to improve the uniformity of the deposited dielectric material for large housing to slow-wave structure diameter ratios.

The mandrel 14 is then removed simply by mechanically pulling it out of the assembly, leaving the structure shown in FIG. 5. The masking helix 18 is then removed by chemical etching using the aforementioned predetermined etchant to provide the structure illustrated in FIG. 6. As a specific example for illustrative purposes, for any combination of the aforementioned exemplary ribbon, mandrel and dielectric materials, the predetermined etchant may be a dilute solution (0.1 to 10 molar solution, for example) of sodium hydroxide in water, although other etchants are suitable as well.

Figure 6:
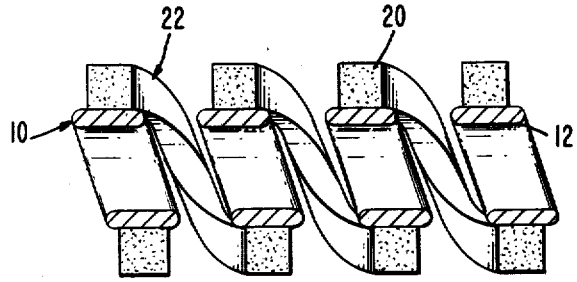

As may be seen from FIG. 6, in the resulting assembly the remaining deposited dielectric material 20 forms a supporting helix 22 coaxially disposed about and wound in the same sense as the slow-wave structure helix 10. The dielectric supporting helix 22 extends radially outwardly from the outer circumferential surface of the slow-wave structure helix 10 and is bonded thereto by the adhesion inherent in the deposition operation. Moreover, since in the fabrication process described above, the masking helix 18 overlaps portions of adjacent turns of the slow-wave structure helix 10, the resultant dielectric supporting helix 22 has a width less than that of the slow-wave structure helix 10, and both side surfaces of the supporting helix 22 terminate inwardly of the adjacent side edges of the slow-wave structure 10.

Figure 7:
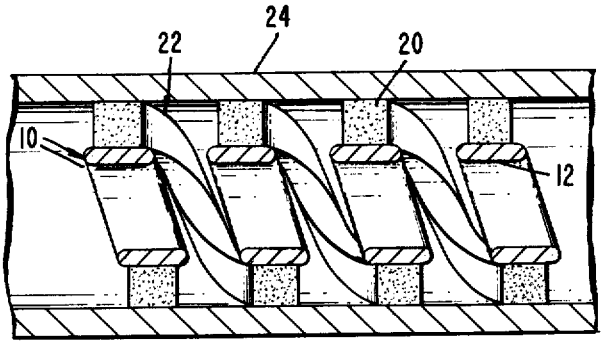

As shown in FIG. 7, the assembly of FIG. 6 may be mounted within a tubular housing 24, which may be of iron and copper, for example, with the circumferentially outer surface of the dielectric supporting helix 22 firmly contacting the inner surface of the housing 24. The operation depicted in FIG. 7 may be carried out using conventional heat shrinking techniques in which the housing 24 is preheated prior to receiving the assembly of FIG. 6, and after insertion of this assembly, is allowed to cool whereby the housing 24 shrinks into binding contact with the circumferentially outer surface of the supporting helix 22.

As may be seen from FIG. 7, since the slow-wave structure helix 10 projects laterally beyond both sides of the adjacent portion of the dielectric supporting helix 22, no dielectric material is present immediately adjacent to the regions directly between successive turns of the slow-wave structure helix 10 where large electromagnetic fields are present. As a result, the interaction impedance between the electron stream and the wave traveling along the slow-wave structure 10 is increased in the traveling-wave tube in which the slow-wave structure is used. This results in greater operating efficiency and higher gain per unit length of the slow-wave structure.

Moreover, since the width of the dielectric supporting helix 22 can be carefully controlled in accordance with the width of the masking helix 18, greater control can be achieved over various design parameters such as the interaction impedance, dielectric loading factor and phase velocity of the traveling wave than with prior art methods for making slow-wave structures having helical dielectric supporting arrangements. In addition, the method of the present invention results in a lower manufacturing cost for slow-wave structure assemblies of this type, and the invention also allows such assemblies to be produced with smaller dimensions than heretofore has been possible, thereby enabling the associated traveling-wave tubes to operate at higher frequencies (e.g. Ku-band and higher) than in the past.

In a further embodiment of the invention, illustrated in FIGS. 8–11, a helical slow-wave structure assembly is provided which affords a varying phase velocity for the traveling wave propagating therealong, thereby enabling a desired velocity relationship to be maintained between the traveling wave and the associated electron stream. Components in the embodiment of FIGS. 8–11 which are the same as or equivalent to respective components in the embodiment of FIGS. 1–7 are designated by the same second and third reference numeral digits as their corresponding components in FIGS. 1–7, along with the addition of a prefix numeral "1".

Figure 8:
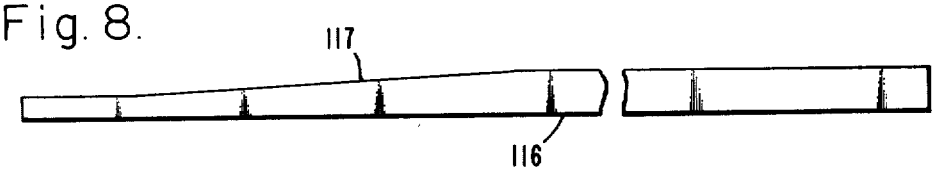
FIG. 8 illustrates a tapered masking ribbon used in fabricating a helical slow-wave structure assembly in accordance with a further embodiment of the invention.
Figure 9:
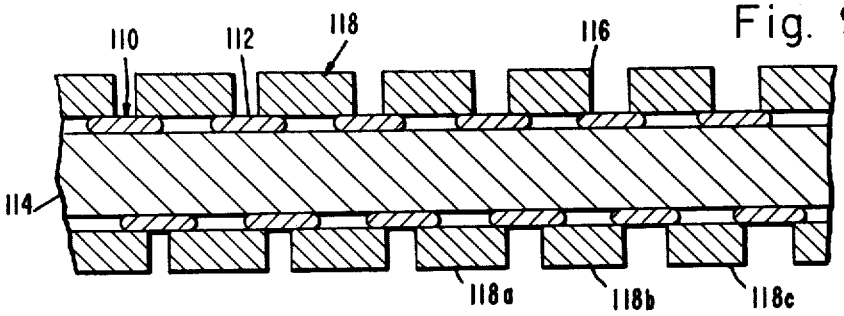
FIGS. 9, 10 and 11 show fabrication stages corresponding to those of FIGS. 2, 4 and 7, respectively, in the fabrication of a slow-wave structure assembly according to the embodiment of the invention using the tapered ribbon of FIG. 8, the resulting assembly being illustrated in FIG. 11.

In the embodiment of FIGS. 8–11, ribbon 116 used to form the masking helix 118 has a portion 117 of tapered width (FIG. 8). Thus, when the ribbon 116 is wound about the slow-wave structure helix 110 as shown in FIG. 9, the width of successive turns 118*a*, 118*b* and 118*c* of the masking helix 118 formed by the tapered ribbon portion 117 decreases gradually as a function of axial distance along the helix 118. Hence, the spacing between the successive helix turns 118*a*, 118*b* and 118*c* which receives the dielectric material 120 being deposited increases correspondingly.

Figure 10:
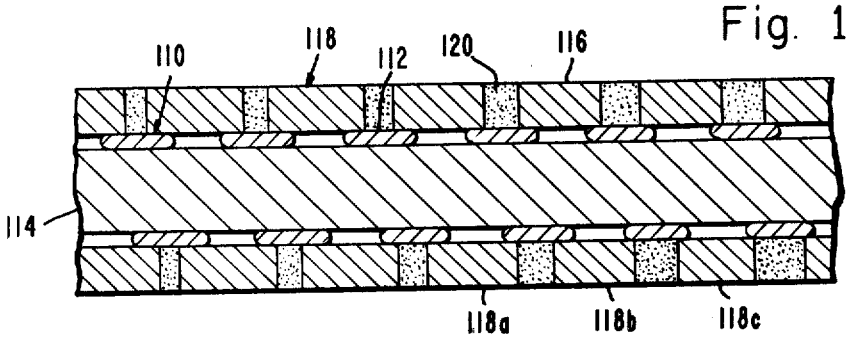
Figure 11:
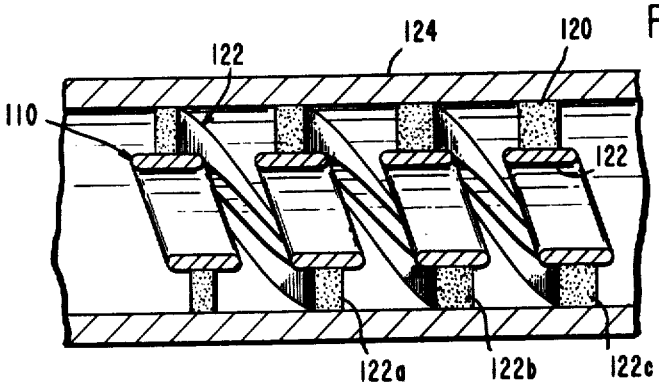

The fabrication of the slow-wave structure assembly of FIGS. 8–11 is carried out in the same manner as described above with respect to the assembly of FIGS. 1–7. The intermediate structure provided after the grinding step is illustrated in FIG. 10, and the final assembly is shown in FIG. 11.

In the slow-wave structure assembly illustrated in FIG. 11, the width of successive turns 122*a*, 122*b* and 122*c* of the dielectric supporting helix 122 increases gradually as a function of axial distance along the helix 122. As a result, a gradually increasing amount of dielectric material is present in the path of the wave traveling along the slow-wave structure helix 110 toward its output end, causing a reduction in the phase velocity of the traveling wave in a manner corresponding to the decrease in the axial velocity of the associated electron stream.

In addition, since less dielectric material is present near the input end of the helix 110, a higher traveling-wave phase velocity and a higher traveling wave-electron stream interaction impedance is provided near the input end than for otherwise comparable assemblies of the prior art. Further, the larger cross-section of the supporting helix 122 near the output end of the assembly affords a greater heat removal capability in a region where it usually is most needed.

A further embodiment of the invention, especially suited to wide bandwidth traveling-wave tubes, is illustrated in FIGS. 12–15. Components in the embodiment of FIGS. 12–15 which are the same as or equivalent to respective components in the embodiment of FIGS. 1–7 are designated by the same second and third reference numeral digits as their corresponding compoents in FIGS. 1–7, along with a prefix numeral "2".

Figure 12:
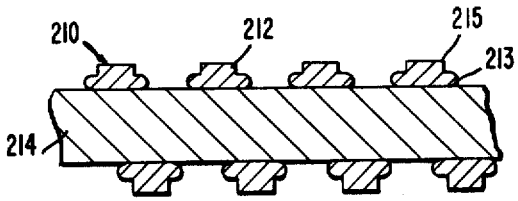
FIGS. 12, 13, 14 and 15 illustrate fabrication stages corresponding to those of FIGS. 1, 2, 4 and 7, respectively, in fabricating a slow-wave structure assembly with a ridged helix according to stll another embodiment of the invention, the resulting assembly being shown in FIG. 15.

In the embodiment of FIGS. 12–15, a ridged slow-wave structure helix 210 is employed which is wound from a ribbon 212 having a base portion 213 and a longitudinal ridge portion 215 of a width less than the width of the base portion 213 which extends outwardly from the base portion 213 such that the base portion 213 defines laterally extending portions on both sides of the ridge portion 215. Preferably, the ridge portion 215 has a width ranging from about one-fourth to about three-fourths of the width of the base portion 213. As shown in FIG. 12, the ribbon 212 is wound on the mandrel 214 such that the base portion 213 contacts the mandrel 214 while the ridge portion 215 extends in a direction radially outwardly from the base portion 213. It is pointed out that although the ribbon 212 is shown as a unitary element, alternatively, a pair of individual ribbons of the desired relative widths may be used to form the base portion 213 and the ridge portion 215, respectively.

Figure 13:
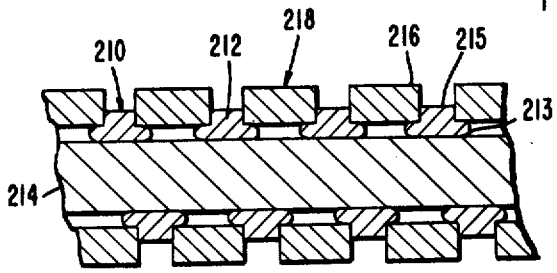

As shown in FIG. 13, masking helix 218 is wound from a ribbon 216 having a width approximately equal to the spacing between adjacent turns of the ridge portion 215 of the slow-wave structure helix 210. The masking helix 218 is disposed between successive turns of the ridge portion 215 in overlapping relationship with the laterally extending regions of the base portion 213 of the slow-wave structure 210.

Figure 14:
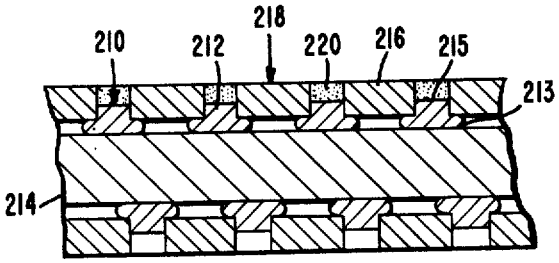
Figure 15:
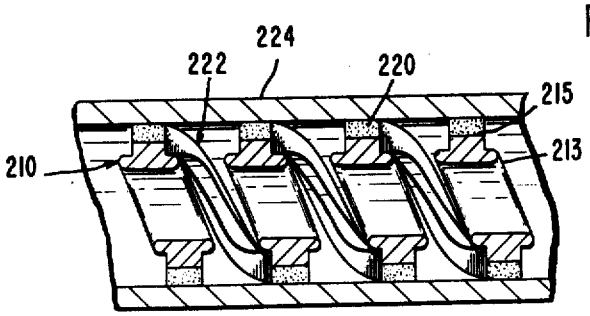

The fabrication of the slow-wave structure assembly of FIGS. 12–15 is carried out in the same manner as described above with respect to the assembly of FIGS. 1–7. The intermediate structure provided after the grinding step is illustrated in FIG. 14, and the final assembly is shown in FIG. 15.

In the slow-wave structure assembly of FIG. 15, the dielectric material of the supporting helix 222 is further removed from the large electromagnetic field regions directly between successive turns of the slow-wave structure helix 210 than in the arrangement of FIG. 7, thereby enabling an even greater improvement in gain and efficiency to be realized. Moreover, the ridge portion 215 of the slow-wave structure helix 210 functions to conductively load the slow-wave structure to provide a phase velocity versus frequency characteristic that facilitates wide bandwidth operation.

In addition, the assembly of FIG. 15 not only is simpler in construction, but it also provides a more constant interaction impedance versus frequency characteristic for waves propagating along the slow-wave structure than in the prior art. This is particularly significant because in the arrangement of FIG. 15 the interaction impedance is increased at frequencies in the upper region of the device passband, thereby increasing operating efficiency and gain at these frequencies.

A still further advantage of the assembly of FIG. 15 results from the fact that for certain low frequency traveling-wave tubes a relatively large radial distance is required between the slow-wave structure helix and its tubular housing. In the past when this distance exceeded the maximum thickness for which plasma-spray techniques could be used effectively to deposit dielectric material, such techniques were not suitable for the fabrication of these tubes. On the other hand, the present invention eliminates this limitation by utilizing the radial extent of the slow-wave structure ridge portion 215 to make up any radial distance differential that may be required.

Although the present invention has been shown and described with reference to particular methods and devices, nevertheless, various changes and modifications which are obvious to a person skilled in the art to which the invention pertains are deemed to lie within the spirit, scope and contemplation of the invention.

What is claimed is:

1. A method for fabricating a helical slow-wave structure assembly comprising:

winding a first ribbon of an electrically conductive material unsusceptible to etching by a predetermined etchant on a cylindrical mandrel to form a first helix having a predetermined spacing between successive turns thereof;

winding a second ribbon of a material susceptible to etching by said predetermined etchant and having a width greater than said predetermined spacing about said first helix over the helical space between turns of said first helix and in overlapping relationship with portions of adjacent turns of said first helix to form a second helix;

depositing dielectric material unsusceptible to etching by said predetermined etchant over the exposed surfaces of said first and second helices;

grinding the deposited dielectric material to a predetermined radial dimension;

removing said mandrel from the resulting assembly;

removing said second helix from the resulting assembly by chemical etching using said predetermined etchant; and mounting the resulting assembly within a tubular housing with the circumferentially outer surface of the dielectric material firmly contacting the inner surface of said housing.

2. A method according to claim 1 wherein at least a portion of said second ribbon has a tapered width, whereby the spacing between adjacent turns of said second helix formed by said tapered portion of said second ribbon varies gradually as a function of axial distance along said second helix.

3. A method according to claim 1 wherein said first ribbon has a base portion and a longitudinal ridge portion of a width less than the width of said base portion extending outwardly from said base portion such that said base portion defines laterally extending portions on both sides of said ridge portion, said first ribbon being wound on said mandrel such that said ridge portion extends radially outwardly from said base portion, said second ribbon having a width approximately equal to the spacing between adjacent turns of said ridge portion and being disposed between successive turns of said ridge portion in overlapping relationship with said laterally extending portions.

4. A method according to any of claims 1, 2 or 3 wherein said electrically conductive material is selected from the group consisting of copper, copper-plated tungsten and copper-plated molybdenum; said mandrel is of a material selected from the group consisting of molybdenum and tungsten; said second ribbon is of aluminum; and said dielectric material is selected from the group consisting of beryllia and alumina.

5. A helical slow-wave structure assembly comprising:

a first helix of electrically conductive material coaxially disposed within a tubular housing;

a second helix of dielectric material coaxially disposed about and wound in the same sense as said first helix, said second helix being bonded to the outer circumferential surface of said first helix and extending radially outwardly therefrom into firm contact with said tubular housing; and the width of at least a portion of said second helix varying gradually as a function of axial distance along said helices.

6. An assembly according to claim 5 wherein the width of said second helix is less than the width of said first helix.

7. A helical slow-wave structure assembly comprising:

a first helix of electrically conductive material coaxially disposed within a tubular housing, said first helix having a base portion and a longitudinal ridge portion of a width less than the width of said base portion extending radially outwardly from said base portion; and a second helix of dielectric material coaxially disposed about and wound in the same sense as said first helix, said second helix being bonded to the outer circumferential surface of said ridge portion and extending radially outwardly therefrom into firm contact with said tubular housing.

8. An assembly according to claim 7 wherein the width of said second helix is approximately equal to the width of said ridge portion.

9. An assembly according to claim 7 wherein said base portion extends laterally beyond both sides of said ridge portion.

10. An assembly according to claim 7 wherein said ridge portion has a width ranging from about one-fourth to about three-fourths of the width of said base portion.

11. An assembly according to any of claims 5, 6, 7, 8, 9 or 10 wherein said electrically conductive material is selected from the group consisting of copper, copper-plated tungsten and copper-plated molybdenum; and said dielectric material is selected from the group consisting of beryllia and alumina.

* * * * *